US010535961B2

(12) United States Patent
Cote

(10) Patent No.: US 10,535,961 B2
(45) Date of Patent: Jan. 14, 2020

(54) ELECTRICAL CABLES HAVING INTEGRATED AND MANUALLY CONTROLLABLE IDENTIFICATION AND ILLUMINATION LIGHT SOURCES

(71) Applicant: Ryan E. Cote, Blacklick, OH (US)

(72) Inventor: Ryan E. Cote, Blacklick, OH (US)

( * ) Notice: Subject to any disclaimer, the term of this patent is extended or adjusted under 35 U.S.C. 154(b) by 1 day.

(21) Appl. No.: 15/496,068

(22) Filed: Apr. 25, 2017

(65) Prior Publication Data

US 2017/0310060 A1 Oct. 26, 2017

Related U.S. Application Data

(60) Provisional application No. 62/327,641, filed on Apr. 26, 2016.

(51) Int. Cl.
*H01R 13/717* (2006.01)
*F21V 23/04* (2006.01)
(Continued)

(52) U.S. Cl.
CPC ..... *H01R 13/7175* (2013.01); *F21L 4/02* (2013.01); *F21V 23/0414* (2013.01); *H01R 13/7172* (2013.01); *F21Y 2115/10* (2016.08)

(58) Field of Classification Search
CPC ..... H01R 13/7175; H01R 13/6658; H01R 13/7172; H01R 13/717; H01R 13/6691; H01R 31/065; H01R 24/62; H01R 13/631; H01R 13/6641; H01R 13/70; H01R 13/6683; H01R 13/701; H01R 2107/00; H01R 13/502; H01R 13/641; H01R 13/665; H01R 13/6675; H01R 2103/00; H01R 2201/06; H01R 24/38; H01R 29/00; H01R 3/00; H01R 13/465; H01R 13/5804; H01R 13/5845; H01R 13/6205; H01R 13/6275; H01R 13/648; H01R 13/652; H01R 13/6585; H01R 13/6592; H01R 13/7177; H01R 2105/00; H01R 24/20; H01R 24/22; H01R 24/60; H01R 24/70; H01R 25/003; H01R 27/02; H01R 31/06
(Continued)

(56) References Cited

U.S. PATENT DOCUMENTS 7,049,937 B1 * 5/2006 Zweig ..... H01R 13/641 324/66
7,466,082 B1 * 12/2008 Snyder ..... H05B 33/0818 315/200 A
(Continued)

*Primary Examiner* — Edwin A. Leon
*Assistant Examiner* — Matthew T Dzierzynski
(74) *Attorney, Agent, or Firm* — Frank H. Foster; Kremblas & Foster

(57) ABSTRACT

A cable for communicating digital or analog signals between connectors at its opposite ends has means for indicating to an installer who has access to one end of the cable which connector is connected at the opposite end of the same cable. A light source is mounted in each connector that is powered by a battery in the connectors and can be turned on from a switch in the connector at the opposite end. The light source is configured to radiate light both transversely from its connector for an indicator function and also longitudinally from its connector for an illumination function. Implementation with logic circuits, microcontrollers and/or other semiconductor devices allows for a variety of embodiments.

8 Claims, 7 Drawing Sheets

(51) Int. Cl.
*F21L 4/02* (2006.01)
*F21Y 115/10* (2016.01)

(58) Field of Classification Search
USPC ..... 439/490, 488, 56, 607.46, 620.22
See application file for complete search history.

(56) References Cited

U.S. PATENT DOCUMENTS 7,544,909 B2 * 6/2009 Dhir ..... H01R 13/7175 200/51.11
7,674,003 B2 * 3/2010 Sharrah ..... H01H 13/503 362/202
7,744,231 B2 * 6/2010 Hutchinson ..... G02B 6/0001 362/555
8,267,706 B2 * 9/2012 Patel ..... H01R 13/703 439/188
8,475,203 B2 * 7/2013 Wu ..... H01R 13/6658 439/490
8,856,744 B2 10/2014 Overby
9,028,122 B2 * 5/2015 Tuchrelo ..... H01R 13/7175 362/253
9,160,118 B2 * 10/2015 Tuchrelo ..... H01R 13/665
9,437,966 B2 * 9/2016 Gagne ..... H01R 13/62
9,570,864 B1 * 2/2017 Moyer ..... H01R 13/7175
9,658,269 B2 * 5/2017 Polland ..... G01R 31/04
9,952,258 B2 * 4/2018 Scherer ..... H01R 13/641
2001/0009265 A1 7/2001 Schulz et al.
2006/0017402 A1 * 1/2006 McKinney ..... H05B 33/0818 315/291
2006/0039136 A1 * 2/2006 Probasco ..... H01R 13/652 362/157
2008/0102689 A1 5/2008 Dhir
2010/0309657 A1 * 12/2010 Purdy ..... F21L 4/005 362/200
2013/0039624 A1 2/2013 Scherer et al.
2016/0097801 A1 * 4/2016 Polland ..... G01R 31/04 324/538

* cited by examiner

FIG. 1
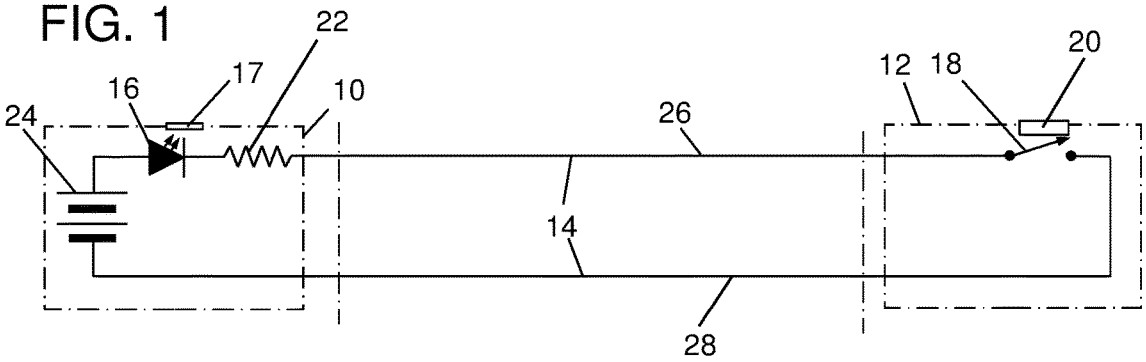
FIG. 2
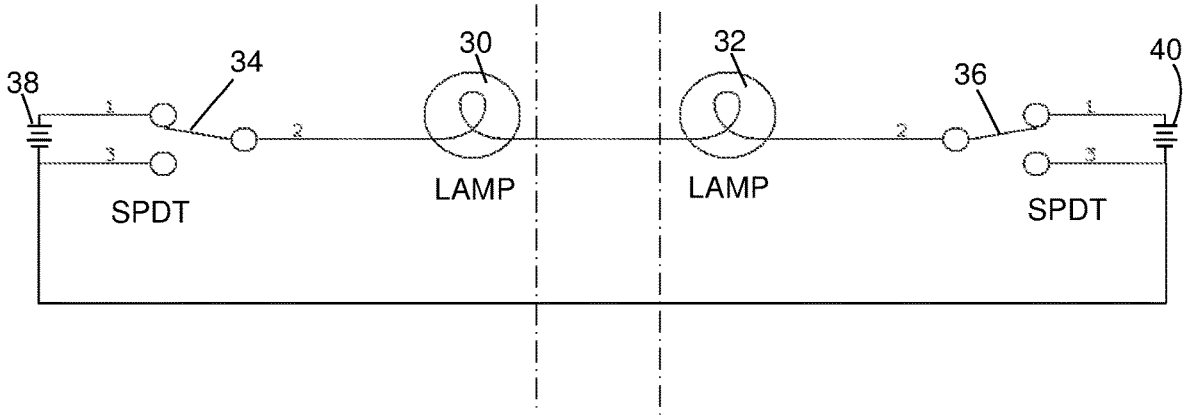
FIG. 3
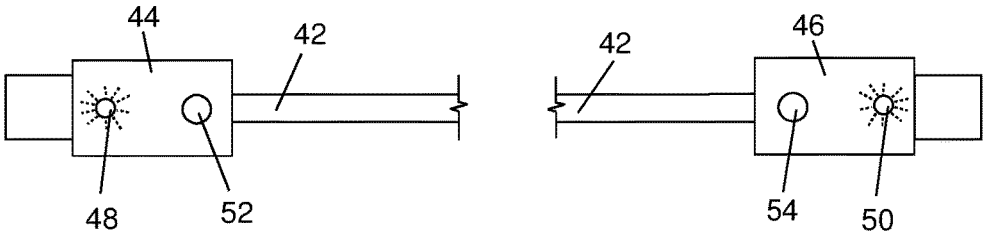
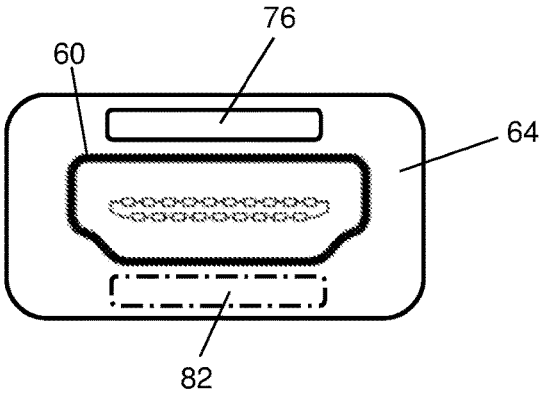
FIG. 6

ELECTRICAL CABLES HAVING INTEGRATED AND MANUALLY CONTROLLABLE IDENTIFICATION AND ILLUMINATION LIGHT SOURCES

CROSS-REFERENCES TO RELATED APPLICATIONS

This application claims the benefit of U.S. Provisional Application No. 62/327,641 filed Apr. 26, 2016 which is hereby incorporated by reference.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

This invention relates to cables that have connectors at their opposite ends and are used for interconnecting computer equipment, audio and video equipment and related equipment by being plugged into mating connectors on the equipment. Typical cables to which the invention is applicable are HDMI and USB cables but the invention can also be adapted to other cables such as display port cables and CAT 5 and CAT 6 network cables. More particularly the invention relates to modifications of currently available cables in order to allow an installer, who has access to one end of a cable, to identify the opposite end of the same cable and preferably to additionally provide illumination that can assist in the insertion of the cable's connector into a mating connector mounted on the equipment.

The age of information technology has brought the development of many devices that require interconnection to other devices by means of digital data and/or analog signal transferring cables. Such cables typically have an intermediate flexible cord which is a multiplicity of electrical conductors or optical fibers that are bundled together in an outer sheath. The electrical conductors or optical fibers transmit signals and extend between industry-standard connectors to which they are connected at opposite ends of the cable. Because the term "cable" is sometimes used to refer to only the bundled conductors and sometimes used to refer to the combination of the bundled conductors and the end connectors, the term cable is used herein to refer to the combination and the word "cord" is used to refer to the bundled conductors.

The diversity, quantity and utility of the devices and equipment that can be interconnected by such cables has made it common for installations of information technology and audio/video equipment to be accompanied by numerous intertwined cables leading between numerous devices along common physical paths in which the cables have the organization of the proverbial "can of worms". A person adding, removing, replacing or maintaining the equipment and who has access to one end of a cable often finds it difficult or impossible to trace along the cable and find its opposite end among numerous other cables and cable end connectors. The task of associating the opposite ends of a cable is even more difficult if the cable's opposite end connector is in a remote location. There is, therefore, a need for an indicator on a distant cable end connector that can be activated by a person who has access to the connector at the opposite end and thereby signal which end connectors are connected to the same cable. Such an indicator would eliminate the need to label the ends of cables during installation and would allow association of cable ends when the cable was not labelled during its original installation.

Additionally, cable end connectors often need to be connected to mating cabinet-mounted connectors, referred to as receptacles, that are located among many nearby similar receptacles in dark or poorly lighted areas. Typically, the cabinet mounted receptacles also have adjacent labels which must be read by an installer in order to choose a desired receptacle. To make a cable connection, the cable connector must be held in the correct orientation and aligned with the mating receptacle in order to properly insert the cable connector into the receptacle. Although flashlights can improve the visibility of the receptacles and their labels, a flashlight may not be available and, if it is, a flashlight requires the use of a person's second hand which is needed, for example, for holding other cables out of the way or for maintaining physical balance. It is therefore desirable to provide a cable end connector with an internal illuminator to assist in the proper insertion of cable connectors into cabinet receptacles.

BRIEF SUMMARY OF THE INVENTION

The invention is an improvement of a cable of the type that is used for coupling digital or analog signals between connectors that are connected to electronic devices and equipment. Such a cable includes an intermediate cord, a first cable connector at a first end of the cable and a second cable connector at the opposite second end of the cable. In its simplest most basic form of the invention a first light source is mounted to a first cable connector and a manually actuated first switch is mounted to a second cable connector. Electrical conductors, including conductors through the cord, connect the first switch, an electrical power source and the first light source so that the first light source at one end connector can be switched to an ON state and to an OFF state by a first switch at the other end connector. This allows an operator holding the connector with the first switch to turn on the first light source at the other end connector so that the light source functions as an indicator signaling which end connector is connected to the same cable as the connector on which the switch was actuated. However, this invention has many varied embodiments, alternatives and enhancements including the ability to use the indicator function from either end of the cable.

BRIEF DESCRIPTION OF THE SEVERAL VIEWS OF THE DRAWINGS

FIG. 1 is a schematic diagram of a circuit embodying the most fundamental embodiment of the invention.

FIG. 2 is a schematic diagram of a simple alternative embodiment of the invention.

FIG. 3 is a top view of a cable embodying the invention.

FIG. 6 is an end view of the connector illustrated in FIGS. 4 and 5.

Figure 4:
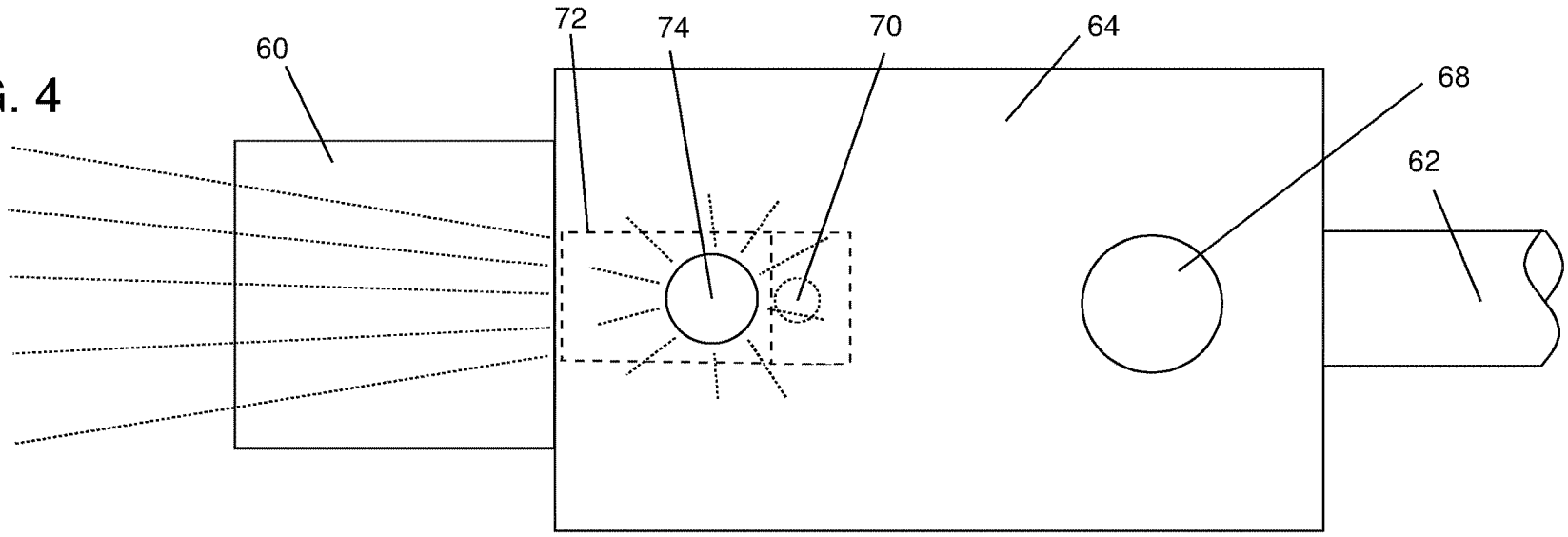
FIG. 4 is a top view of a cable connector embodying the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other circuit elements where such connection is recognized as being equivalent by those skilled in the art. In addition, many circuits are illustrated which are of a type which perform well known operations on electronic signals. Those skilled in the art will recognize that there are many, and in the future may be additional, alternative circuits which are recognized as equivalent because they provide the same operations on the signals.

DETAILED DESCRIPTION OF THE INVENTION

The fundamental concept of the invention is to mount at least one light source to the connector at one end of a cable and at least one switch to the connector at the opposite end of the cable for switching the light source ON and OFF. That light source can then function as an indicator. The principal purpose is to allow a user, who has access to one end of the cable, to identify the opposite end of the same cable by operating a switch at the accessible end of the cable and thereby illuminate the indicator light source at the opposite end of the cable. This concept is enhanced by providing a light source and switch at the connectors at both ends of the cable so that this purpose can be accomplished regardless of which end of the cable the user has access to. Desirably but not necessarily, both indicator light sources are turned on simultaneously and remain on as a result of operating the switch at either one of the end connectors.

This concept can be modified by mounting two light sources at one or both ends. The second light source provides an illumination function and is turned to its ON state and its OFF at least by a switch at the same end of the cable as the second illuminating light source. The second light source is preferably a brighter light source that directs a light beam directly ahead of the connector to illuminate a mating receptacle on an electronic appliance in order to assist the user to connect the mating connector to the receptacle. Alternatively, a single light source can be used for both the indicating and the illumination functions and desirably can have a lesser intensity for the indicator function and a greater intensity for the illumination function. Most desirably, the illumination light source can be switched to its ON and OFF state by a switch located at either end of the cable.

Because it is desirable that the indicator and illumination functions are available when a cable is not connected to equipment at either of its ends, a battery is mounted in at least one and preferably both of the cable end connectors for use as a power source for powering the light source(s) and any associated switching circuitry. Some cables, such as HDMI and USB cables, include conductors that are connected to an external power source in an electronic appliance when one of the connectors is connected to that appliance. The circuit components of the invention can alternatively be connected to those power supply conductors for powering the circuit of the invention but that requires that one end of the cable be connected to equipment.

FIG. 1 shows a cable with a circuit implementing the most fundamental form of the invention which has a single indicator light. The cable has a first connector 10 and a second connector 12 connected together through an intermediate cord 14. Although the cable has many additional signal transmitting conductors for serving its principal purpose of transmitting data or analog signals, they are not shown because they are known in the prior art and are not a part of the invention. A first light source 16, preferably an LED, is mounted to the first cable connector 10. Light emitted from the first light source 16 is visible through a lens or hole 17 in an outer shroud of the first connector 10 and preferably visible from above, below or beside the first connector 10. A manually actuated first switch 18 is mounted to the second cable connector 12. The manually actuated first switch 18 is shown as a SPST momentary push button switch that is actuated by a push button 20. These components are connected in a series circuit to a resistance 22 and an electrical power source 24, which is a battery, through electrical conductors 26 and 28 in the cord 14. From the above it is apparent to those skilled in the art that the battery power source 24 can be located in either the first connector 10 or the second connector 12.

For all embodiments of the invention, the connector's shroud can alternatively be made translucent so that light from the first light source 16 is visible through the shroud instead of requiring a separate hole or protective lens. Desirably, at least a segment of the connector shroud and, if desired, the entire connector shroud is made at least translucent and can also be transparent so that light from an LED or other light source within the connector radiates through the plastic shroud. That way light can be radiated in multiple directions to facilitate both ease of visibility and the use of a single light source to function as both an illuminator and an indicator.

Many different types of manually actuated switches are available that can be used for switching the first light source 16 to an ON state and an OFF state. The SPST momentary push button switch 18, when depressed at the second connector 12, will illuminate the first light source 16 in the first connector 10 as long as the push button switch 18 is held depressed. This allows an installer positioned at the second connector 12 to see which connector at the opposite end of the cord 14 is connected to the same cord as the second connector 12. Upon release of the push button switch 18, the first light source 16 is turned to its OFF state. Alternatively, the first SPST switch 18 can be a SPST push button switch of the type know as a toggle, maintained, ON/OFF, or push on-push off switch. A switch of that type alternates states between ON and OFF each time its button is pushed. The latter switch allows the first light source 16 to remain in its ON state when the push button 20 is released after its initial depression and later turned to its OFF state by a second depression of the push button 20.

In order to allow an installer to access the identification function at either end of the cable, the circuit of FIG. 1 can be replicated but with the circuitry in the first connector 10 replicated in the second connector 12 and the circuitry of the second connector 12 replicated in the first connector 10. Although the same battery can be used for also switching the additional light source in the second connector 12 to its ON state and its OFF state, preferably a second battery is also installed in the second connector 12. However, although this replication of the circuitry of FIG. 1 allows the installer to use the identification function from either end of the cable, an additional conductor extending between the connectors is required.

FIG. 2 illustrates another embodiment of the invention. In this and other figures that have schematic diagrams, vertical dashed lines are used to indicate the boundaries between the end connectors and the interposed cord. The electrical schematic diagram of the circuit of FIG. 2 is essentially the same as the well-known two-way switch circuit long used for operating lighting in buildings. Light source 30 is mounted to one connector and light source 32 is mounted to the opposite end connector. Two SPDT switches 34 and 36 are mounted one in each of the two end connectors and are connected to batteries 28 and 40 as illustrated in FIG. 2. Each of the switches 34 and 36 have two states and consequently the circuit has four states. In two of those states both light sources 30 and 32 are OFF and in two of those states both light sources 30 and 32 are ON. Consequently, an installer at either end of the cable can turn ON both light sources by actuation of either of the switches 34 or 36 from either end of the cable. Those light sources will remain continuously ON for identification of the opposite end connector of the same cable until the installer actuates either of the switches 34 or 36 from either end of the cable.

The circuits of FIGS. 1 and 2 were described above to illustrate their use to provide the indicator function. However, the illumination function can additionally be incorporated into a connector by duplicating the FIG. 1 or FIG. 2 circuit. In the case of the FIG. 1 circuit, the entire FIG. 1 electrical circuit can be duplicated all in one connector so a switch, a light source and a battery are all in the same connector and the light source is positioned to radiate light from the front of its connector. In the case of the FIG. 2 circuit, it can be duplicated so that the duplicate circuit would add the illumination function to the indication function. Although possible, neither of these alternatives is the preferred embodiment of the invention because each connector would have two switches and two light sources.

FIG. 3 shows an example of a physical arrangement of an embodiment of the invention. The intermediate cord 42 has a connector 44 at its left end and a connector 46 at its right end. A light source 48 is mounted in the connector 44 and a light source 50 is mounted in the connector 46. Switches, such as push button switches 52 and 54, are mounted one in each of the two connectors 44 and 46. Although the light sources 48 and 50 can be mounted in any position where their radiated light is visible to an installer, preferably they are mounted on the top of the connectors. For any of the embodiments previously described or to be described, more than one indicator light source and even more than one illumination light source can be mounted at different positions in the connectors to assure that at least one is visible to an installer regardless of the orientation of its connector.

Figure 5:
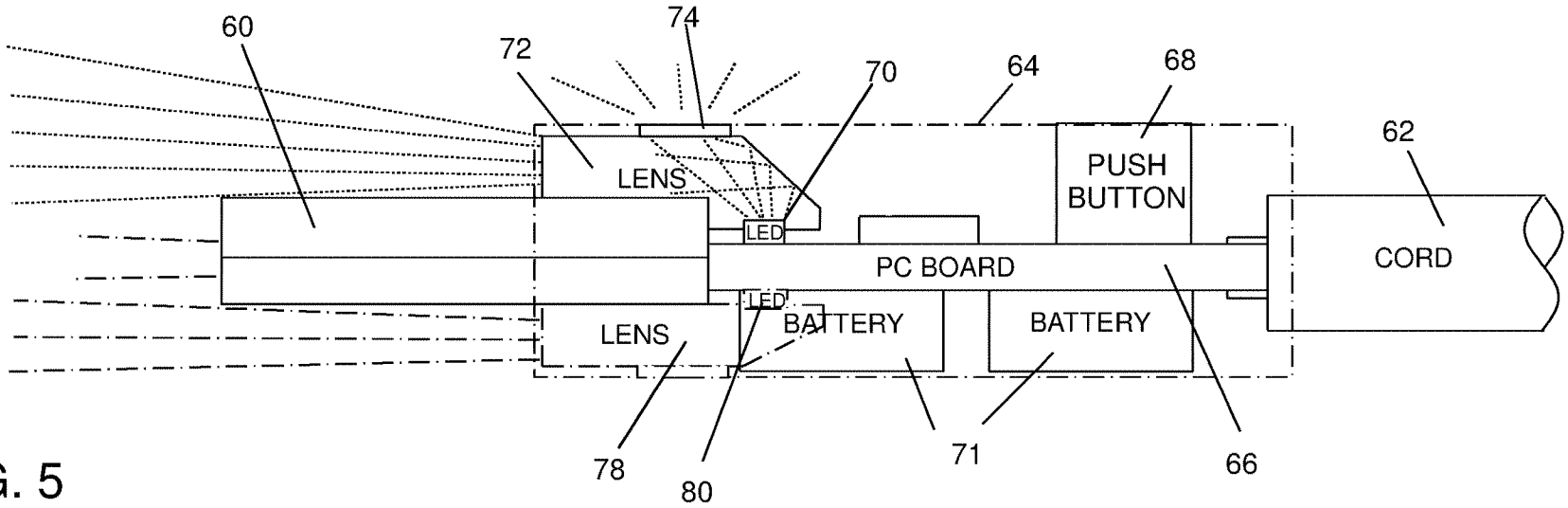
FIG. 5 is a side view of the embodiment of FIG. 4 with its overmolded shroud removed to reveal the configuration of the internal components that are related to the invention.

As previously stated, a single light source in a connector can be used for both the identification purpose and the illumination purpose. FIGS. 4 through 6 illustrate an example of a physical arrangement of circuit elements for implementing the invention in that manner with an HDMI cable. This physical arrangement can be used for the previously described circuits as well as those subsequently described. A conventional connector has a connector housing 60, which contains the electrical conductors and contacts that are electrically connected to conductors in the intermediate cord 62. The connector housing 60 has an overmolded shell or shroud 64 (shown in phantom in FIG. 5) that mechanically supports its internal components and the connector housing 60. The connector housing 60 also provides a hand grip for an installer and physical protection and electrical insulation over the components. In this embodiment of the invention, a printed circuit board 66 extends from the cord 62 to the connector housing 60 and has conductors for connecting the conductors in the cord 62 to the contacts or pins in the conventional connector housing. In addition, a push button switch 68, an LED light source 70, coin batteries 71 and other circuit components are mounted to the printed circuit board 66. A transparent lens 72 is mounted above the LED 70 and functions as a light guide.

A portion of the light from the LED 70 is transmitted through the lens 72 and out through an opening 74 (or secondary transparent lens) from the overmolded shroud 64 in a transverse direction for the indication function of the invention. The direction of the outward radiation from the indicating light source is preferably transverse, and most preferably out the bottom, top or sides of the connector shroud 64, so that the light will be visible to an installer from any direction. In addition, a portion of the light from the LED 70 is reflected within the lens 72 into a longitudinal direction away from the cord 62 and out through an opening or a secondary protective lens 76 (FIG. 6). That direction of light radiation provides the illumination function by directing light that will be incident upon and illuminate any object facing the open end of the connector housing 60. Preferably the illuminating light is transmitted directly out from the end of the shroud 64 and approximately parallel to the connector housing 60 where it can best illuminate a receptacle into which the connector housing 60 is to be connected.

FIG. 5 also illustrates in phantom lines that a second light guide lens 78, and a second LED 80 can be provided below (on the opposite side of) the printed circuit board 66 and arranged in an inverted configuration from the lens 72 and LED 70 on the upper side of the printed circuit board 66. This second LED 80 can provide an additional illumination function by radiating additional light out through a hole or secondary protective lens 82 (FIG. 6). In addition or in the alternative, an LED can be positioned to radiate light for the illumination purpose out through the connector housing 60.

Because a light source used for identification should have a switch for operating that light source at the opposite end of the cable, electrical conductors between the ends of the cable are required. Circuits that implement the invention require at least two, and for some embodiments three, conductors extending between the end connectors. Some cables, including some HDMI cables, have conductors in the standard cable that are not used for some applications. For example, some HDMI cables have conductors connected to pins 15 and 16 and a "ground" conductor connected to pin 17. These conductors can be used for implementing embodiments of the invention for some uses. Using such unused conductors already in a standard cable eliminates the need for providing additional conductors in the cord for use with embodiments of the invention. The additional conductors could interfere with the electrical properties of the cable in a way that deteriorate the signals transmitted through the cable. Of course such additional conductors can be added to the industry-standard conductors when necessary or desirable.

From the above description it should be apparent to those skilled in the art that a manually actuated switch mounted to at least one connector and a light source mounted to at least the other connector are critical to the invention. Therefore, the meaning of the term "switch" and the term "connector" as applied to the invention are important to an understanding of the invention.

The term "connector" has a relatively standard meaning in the art. However, the invention can be implemented by equivalent configurations for which it may not be clear that a switch and/or a light source is in or mounted to the "connector" according to its common meaning. Although these implementations may be impractical or needlessly increase cost, they are possible. As one example, a separate housing can be connected to a conventional end connector by a very short cord and components of the invention can be mounted in the separate housing. By placing a separate housing near each conventional end connector and mounting at least one switch in one separate housing and at least one light source in the other separate housing, the advantages of the invention can be realized. However, such a construction is equivalent because the end connector of that implementation of the invention merely provides two part end connectors distributed in two casings that are connected by a short segment of cord. As another example, a pair of adapters can be constructed each with components of the invention mounted in the adapters instead of in the conventional end connectors. Each such adapter would have a male and a female end that would connect at each of the opposite ends of a conventional cable and to a cable receptacle in a device. This too is equivalent because the effective end connector at each end of the cable is simply constructed in two parts in two housings that are coupled together. These equivalent configurations would be conveniently facilitated by the use of conductors already in a standard cable and used as described above.

The term "switch" is commonly used in the electronic arts. Sometimes it is applied to a mechanical device for switching an electrical current between an ON state and an OFF state. In addition there are switching circuits in which multiple electronic components are connected in a circuit, perform the same switching function and can be collectively referred to as a switch. Taken together the switching circuit is a switch because it too switches an electrical current between an ON state and an OFF state. In addition, a microprocessor can be used to provide a virtual switch by using applied inputs from an electronic component, such as a capacitance switch, to vary its outputs according to its programmed instructions or algorithm. The outputs control other electronic components, such as a MOS/FET, to switch an electrical current between an ON state and an OFF state. Switches can be momentary; that is in an ON state only while being manually actuated. Switches can also toggle; that is when actuated they switch between their ON state and their OFF state and remain in that state until they are again actuated. These various forms of a "switch" can be useful in implementing embodiments of the invention.

Figure 7:
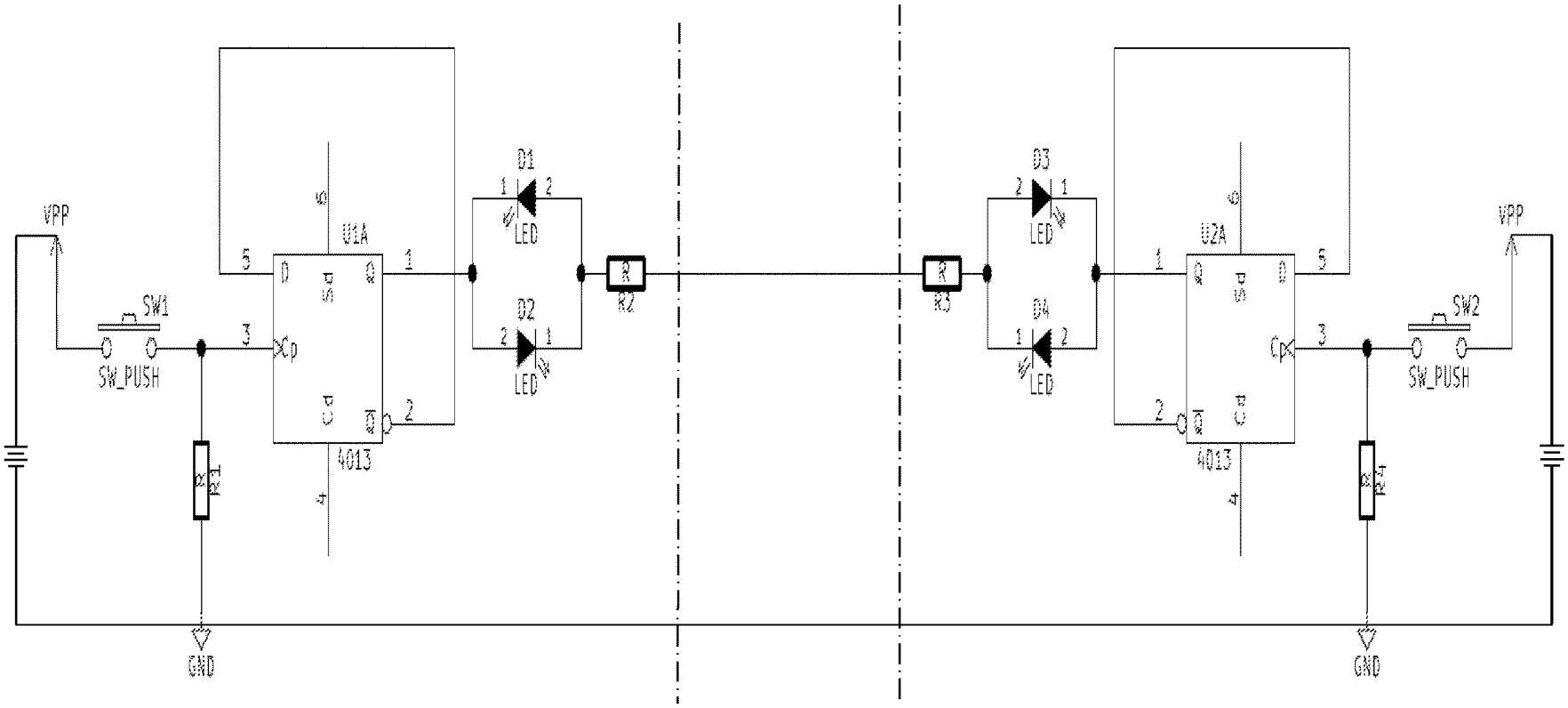
FIG. 7 is a schematic diagram of the electrical circuit of an embodiment of the invention.

FIG. 7 illustrates an electronic switching circuit that can be used to implement the invention. This circuit uses momentary push button switches sw1 and sw2, one in each connector, with flip-flops U1A and U2A so that the momentary switches sw1 and sw2 toggle LEDs D1-D4 between an OFF state and an ON state to provide indicating lights similar to the embodiment of FIG. 2. Each depression of a momentary push button switch sw1 or sw2 toggles the state of the D flip-flop U1A or U2A to which the push button switch sw1 or sw2 is connected. If the Q outputs (pin 1) of U1A and U2A are both HIGH or both LOW, no current flows through the light-emitting diodes (LEDs) and resistors, and none of the LEDs is illuminated. However, if the Q output of U1A (U1A pin 1) is HIGH and the Q output U2A pin 1 is LOW, current flows through D2 and D3, turning on the indicating diodes at each connector. Conversely, if U1A pin 1 is LOW and U2A pin 1 is HIGH, current flows through D1 and D4, again turning on the indicating feature at each connector. Like the two-way switch configuration of FIG. 2, dedicated conductors must extend between the connectors.

Figure 8:
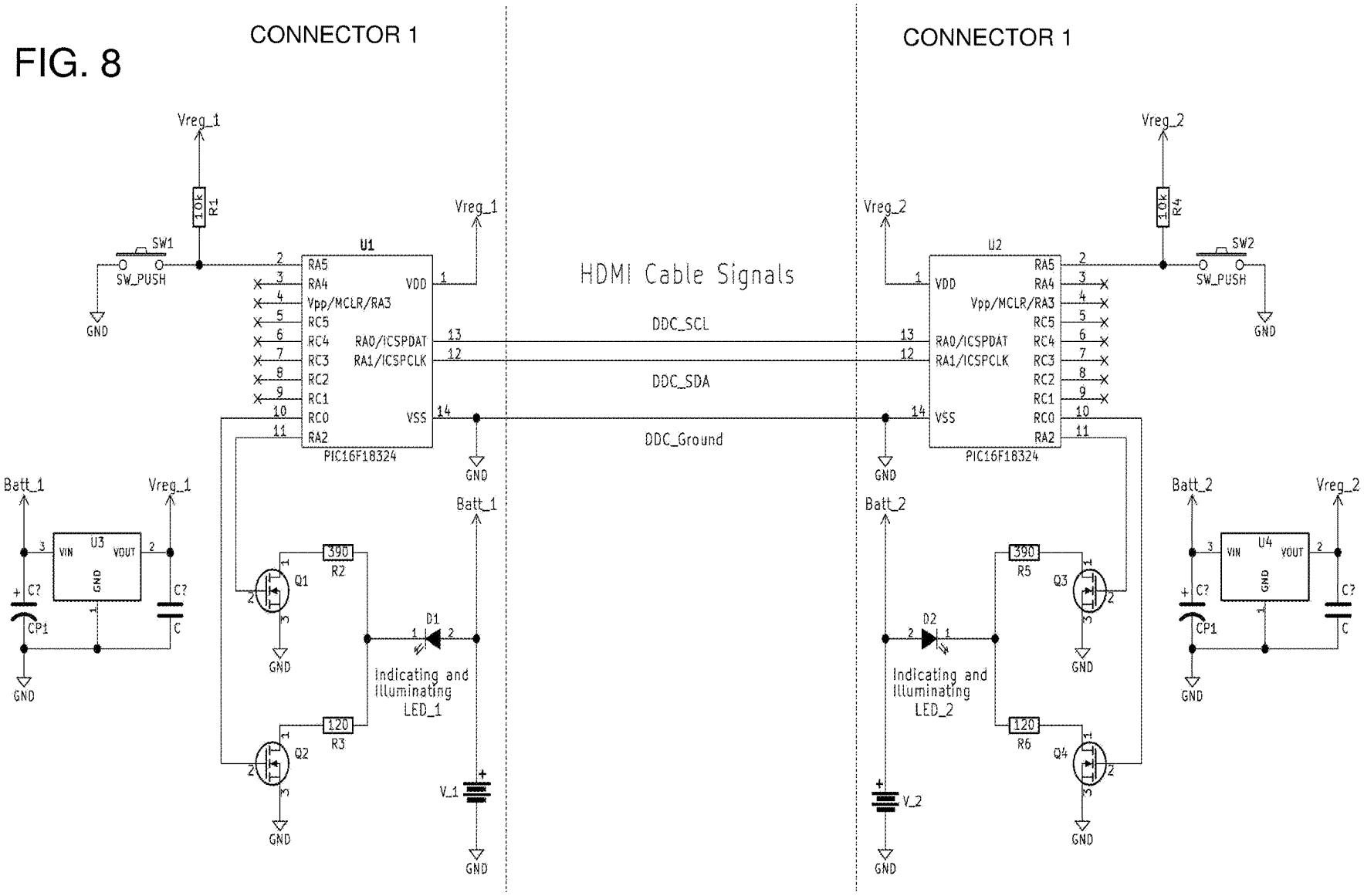
FIG. 8 is a schematic diagram of the electrical circuit of the preferred embodiment of the invention.

FIG. 8 illustrates the electronic circuit of the preferred embodiment of the invention. It is preferred because it combines several desirable features. The FIG. 8 circuit requires only one switch in each connector which are momentary push button switches SW1 and SW2. Such switches are the least costly and most reliable form of push button switch. The FIG. 8 circuit also requires only one light source D1, D2 in each connector so each light source can be mounted in its connector to serve both the indicator function and the illumination function. Additionally, the light sources D1 and D2 have a greater light intensity for illumination and a lesser light intensity for indication and therefore minimizes battery power consumption. The circuit of FIG. 8 is particularly suitable for use with the physical features illustrated in FIGS. 4-6.

In the FIG. 8 circuit, the switches SW1 and SW2 are each an input to one of two 8-bit microcontrollers U1 and U2, one microcontroller being located in each connector. The two microcontrollers U1 and U2 are connected together through conductors in the cord portion of the cable. In Connector 1, MOSFET Q1 controls current flow through resistor R2 and LED D1 for the indicating feature. MOSFET Q2 controls current flow through resistor R3 and LED D1 for the projected illumination feature. Because a higher illumination intensity and therefore greater current is desired for the illumination function than for the indication function, resistor R3 is a smaller series resistor than resistor R2. In connector 2, MOSFET Q3 and resistor R5 are associated with and control the indicating feature of D2 and MOSFET Q4 and resistor R6 are associated with and control the illumination in the same manner as the corresponding circuit elements in connector 1.

Figure 9:
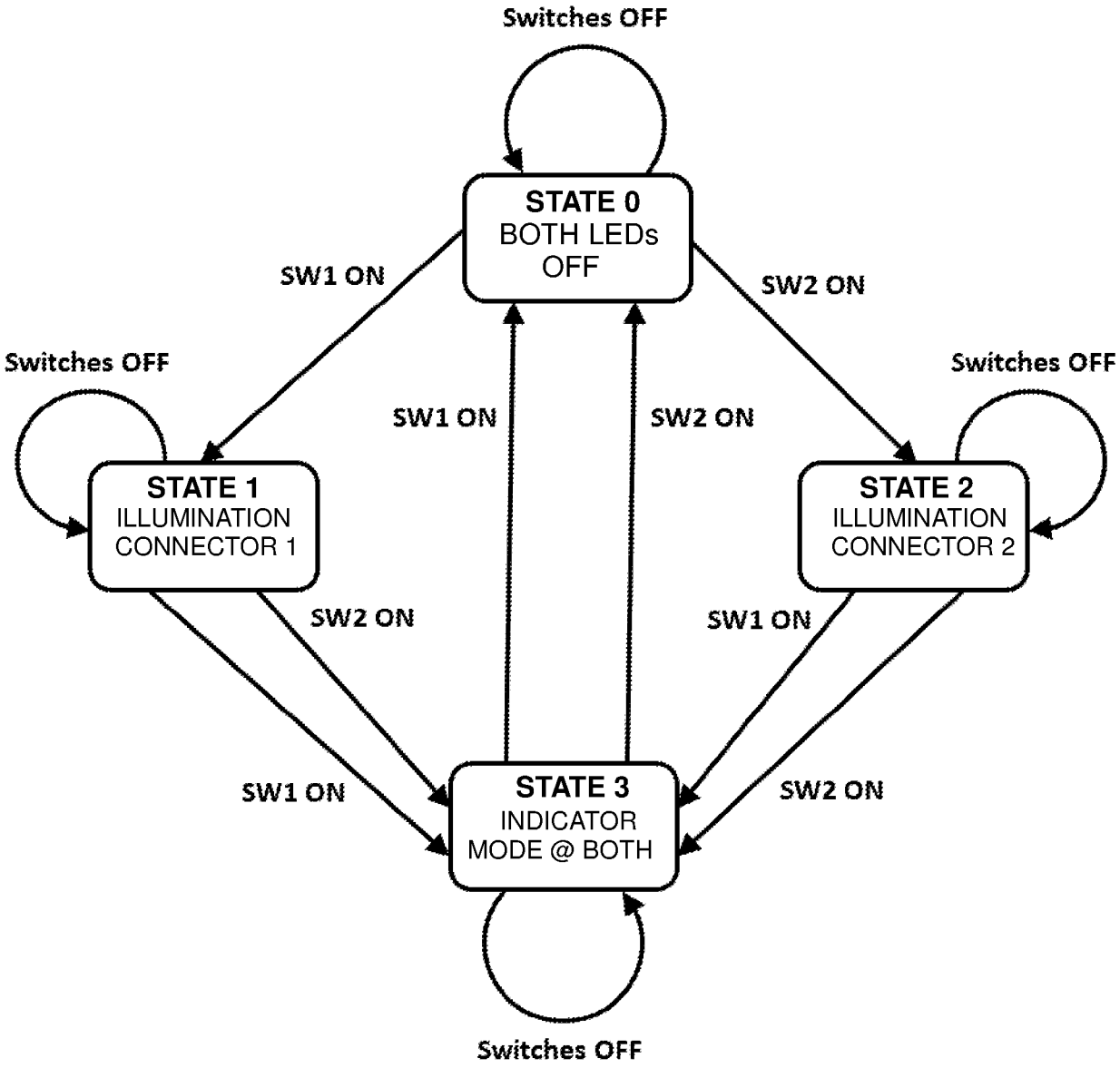
FIG. 9 is a State diagram illustrating the operation of the preferred embodiment of FIG. 8.

The indicating and illuminating functions of the FIG. 8 circuit are accomplished through a sequence of push button presses of switches SW1 and SW2 on either one or both connectors. The operation of the FIG. 8 circuit can be explained with the assistance of the state diagram of the operating states as shown in FIG. 9.

In State 0 the LED light sources D1 and D2 of both connectors are OFF and will remain in that state as long both switches are OFF or not activated by being depressed. If SW1 in Connector 1 is pressed and momentarily turned ON, the system moves to State 1, in which MOSFET Q2 is switched to its conducting state turning ON the LED D1 in Connector 1 and placing it in the illumination mode projecting its higher intensity light from the connector 1. Like State 0, the system will remain in State 1 as long neither switch is activated.

If, while in State 1, SW1 OR SW2 (either switch on either connector) is depressed, MOSFET Q2 is switched to its non-conducting state turning OFF the LED D1 in Connector 1 thereby turning OFF the illumination feature. Also MOSFETs Q1 and Q3 are switched to their conducting states and thereby turn ON LEDs D1 and D2. This moves the system to State 3 turning on the indicating feature of State 3. In this state, LEDs D1 and D2 in both connectors are illuminated at the lower intensity and may be blinking or have some other feature that distinguishes them from the the projected illumination function.

While in State 3, another activation of either push button switch SW1 or SW2 will extinguish the LEDs and return the system to State 0.

If the system is in State 0 and push button switch SW2 is activated and momentarily turned ON, the system moves to State 2, switching MOSFET Q4 to its conducting state thereby turning ON LED D2 and activating the illumination feature of connector 2.

While in State 2, an activation of either push button switch SW1 or SW2 moves the system into State 3, where both connectors are again in the indicating mode.

Figure 10:
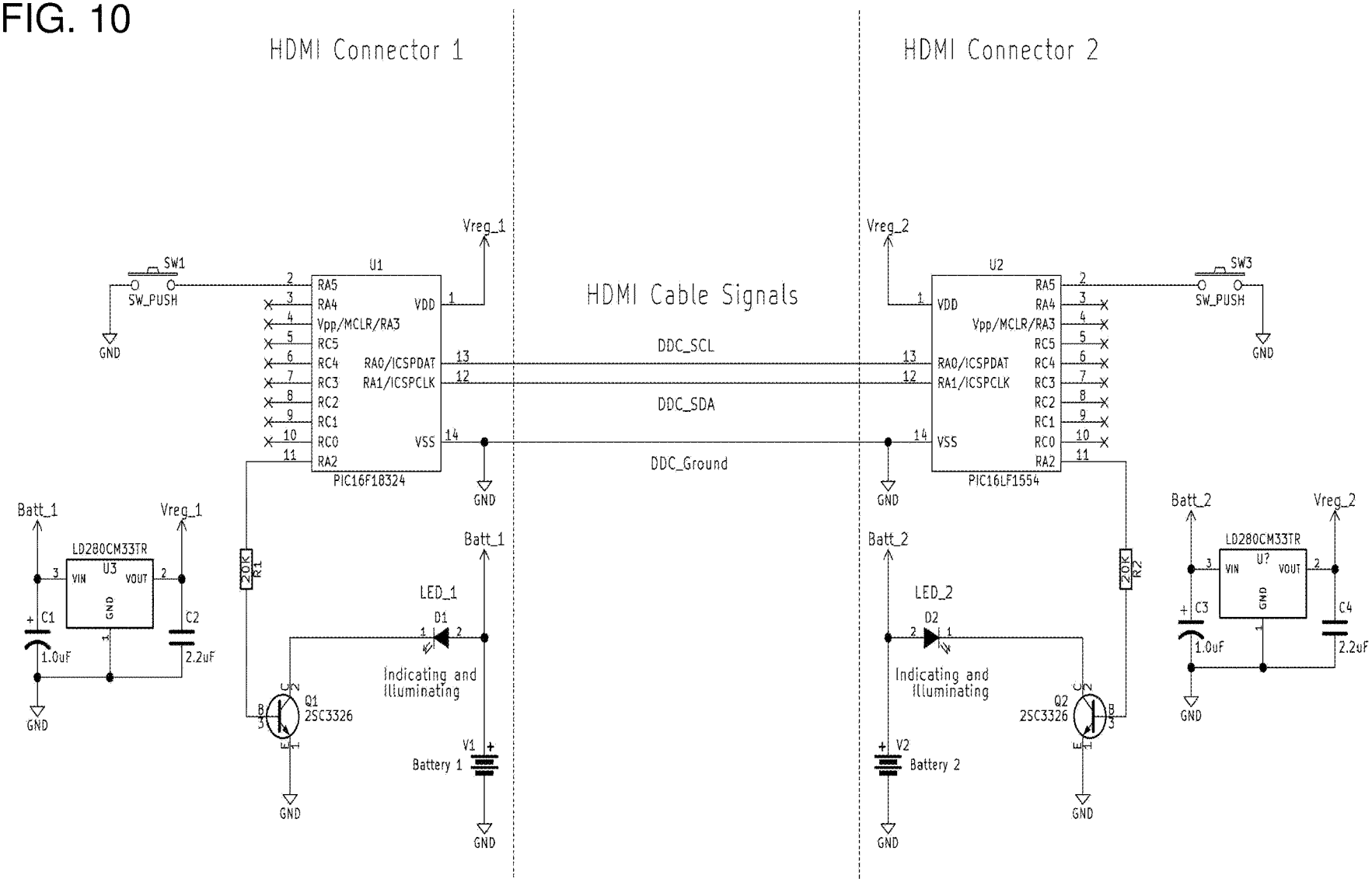
FIG. 10 is a schematic diagram of the electrical circuit of another embodiment of the invention.

FIG. 10 illustrates an alternative similar embodiment of the invention using microcontrollers U1 and U2. In the embodiment of FIG. 10 only one LED (Q1, Q2) at each connector provides the light source for both the illumination and the identification modes. This circuit, however, does not have the dual intensity feature of the circuit of FIG. 9.

Figure 11:
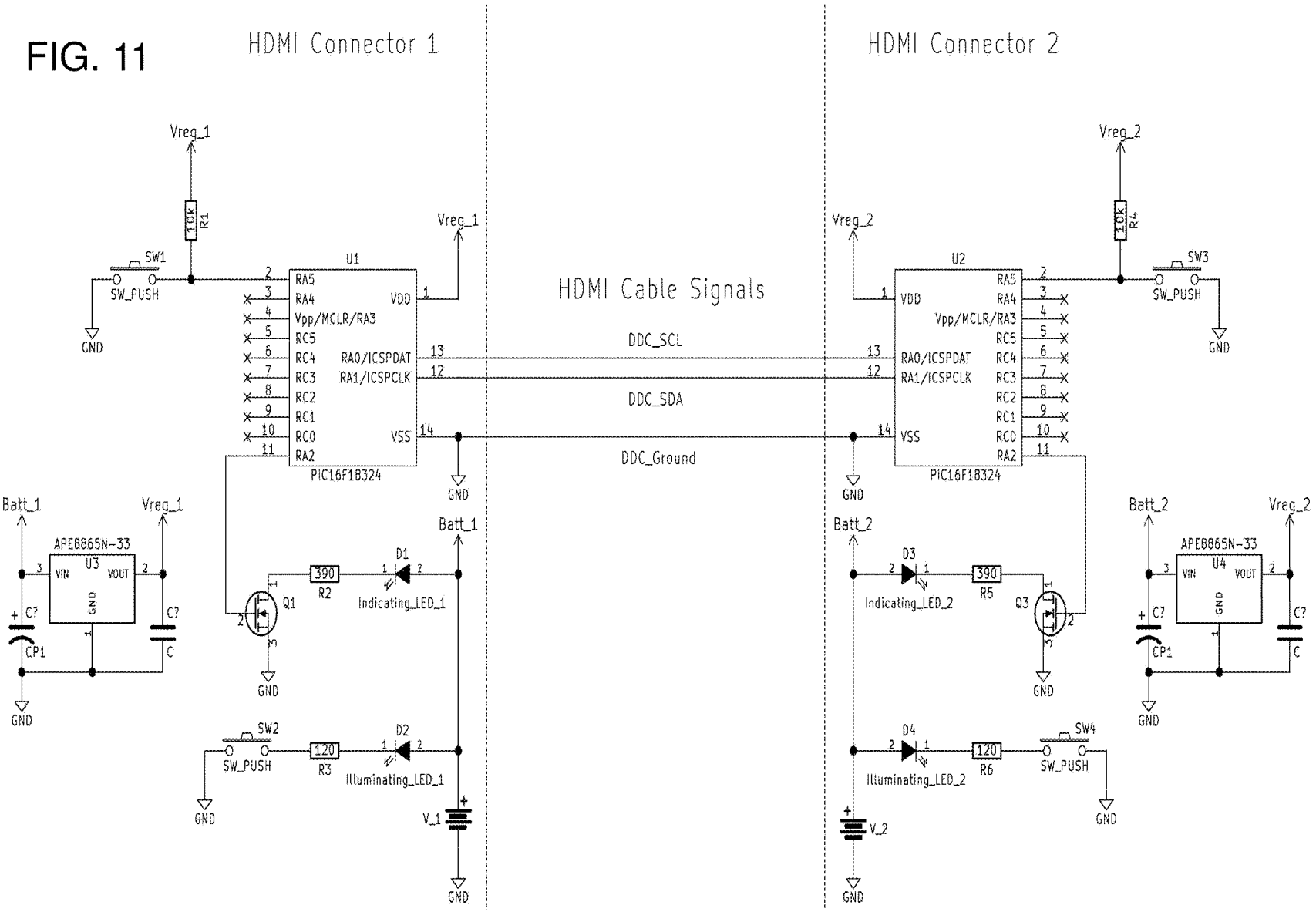
FIG. 11 is a schematic diagram of the electrical circuit of still another embodiment of the invention.

FIG. 11 illustrates yet another similar alternative embodiment of the invention using microcontrollers U1 and U2. Although similar is structure and operation, the circuit of FIG. 11 has two push button switches SW1 and SW2 in connector 1 and two push button switches SW3 and SW4 in connector 2. This circuit also has two LEDs D1 and D2 in connector 1 and two LEDs D3 and D4 in connector 2. For the illumination mode in connector 1, switch SW2 switches LED D2 between its ON state and its OFF state. For the illumination mode in connector 2, switch SW4 switches LED D4 between its ON state and its OFF state. As seen from the circuit diagrams, the illumination mode circuit in both connectors 1 and 2 is essentially the same circuit as illustrated in FIG. 1. For the indication mode, the microcontrollers U1 and U2 switch the MOSFETs Q1 and Q3 in their respective connectors between their conducting and non-conducting states. The MOSFETs Q1 and Q3 control the LEDs D1 and D3 to turn them ON and OFF according to the programming of the microcontrollers U1 and U2. The microcontrollers U1 and U2 can be programmed to either turn the LEDs D1 and D3 both ON at the same time. Alternatively, the microcontrollers U1 and U2 can be programmed to turn ON only the LED at one connector when the push button switch SW1 or SW3 at the other connector is depressed.

The detailed description illustrates various embodiments of the invention using some of the possible combinations of light sources, switch types, and switch locations as well as various switches, including mechanical switches, capacitance switches and electronic switches which may include logic circuits and/or a microcontroller and combinations of them. A person skilled in the art will recognize that there are many additional and different circuits that can be designed for implementing the present invention. The invention can be implemented in simple switching circuits connected to a source of power and light sources, with the use of logic circuits and flip-flops and well as with a programmed microprocessor, microcontroller or digital logic circuits connected to switches, a source of power and light sources.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A cable including an intermediate cord, a first cable connector connected to a first end of the cord and a second cable connector connected to the opposite second end of the cord for coupling digital or analog signals through the cord and between the connectors, the cable further comprising:

(a) a first light source mounted to the first cable connector;

(b) a manually actuated first switch mounted to the second cable connector;

(c) an electrical power source comprising at least two batteries, one of the two batteries being mounted in each of the two connectors;

(d) electrical conductors through the cord and connecting the first switch, the power source and the first light source for switching the first light source to an ON state and an OFF state;

(e) a second light source mounted to the second cable connector;

(f) a manually actuated second switch mounted to the first cable connector; and (g) the second switch, the power source and the second light source connected through the electrical conductors for switching the second light source to an ON state and an OFF state;

(h) a first microcontroller in the first connector having the second switch being a momentary SPST push button switch connected to an input of the first microcontroller and the first light source connected to an output of the first microcontroller;

(i) a second microcontroller in the second connector having the first switch being a momentary SPST push button switch connected to an input of the second microcontroller and the second light source connected to an output of the second microcontroller; and (j) wherein the first light source is connected along two circuit paths to two different outputs of the first microcontroller through two different transistors and the second light source is connected along two circuit paths to two different outputs of the second microcontroller through two different transistors.

2. A cable according to claim 1 wherein each connector has a translucent over-molded outer shroud for transmission of light from the light sources through the shroud.

3. A cable according to claim 1 wherein each light source is positioned to direct light from its connector in a longitudinal direction away from the cord for illuminating an object facing its connector and also to direct light from its connector in a transverse direction for indicating a connector having an illuminated light source.

4. A cable according to claim 3 wherein each connector has a translucent over-molded outer shroud for transmission of light from the light source(s) through the shroud.

5. A cable according to claim 1 wherein the first light source and the second light source are each positioned to direct light from its connector in a transverse direction for indicating a connector having an illuminated light source and wherein the cable further comprises:

(a) a third light source mounted to the first connector and positioned to direct light from its connector in a longitudinal direction away from the cord for illuminating an object facing its connector, the third light source being connected to a switch mounted to the first connector for switching the third light source between an OFF state and an ON state; and (b) a fourth light source mounted to the second connector and positioned to direct light from its connector in a longitudinal direction away from the cord for illuminating an object facing its connector, the fourth light source being connected to a switch mounted to the second connector for switching the fourth light source between an OFF state and an ON state.

6. A cable according to claim 5 wherein each connector has a translucent over-molded outer shroud for transmission of light from the light sources through the shroud.

7. A cable according to claim 1 wherein the connection paths between the first light source and the first microcontroller each includes a resistor having values of resistance that differ from each other for providing two different light intensities and the connection paths between the second light source and the second microcontroller each includes a resistor having values of resistance that differ from each other for providing two different light intensities.

8. A cable according to claim 7 wherein the light sources are LEDs controlled by a MOSFET.

* * * * *